US007331075B2

(12) United States Patent
Lee et al.

(10) Patent No.: US 7,331,075 B2
(45) Date of Patent: Feb. 19, 2008

(54) SPIN-DRY CONTROL METHOD IN WASHING MACHINE

(75) Inventors: Tae Hee Lee, Seoul (KR); Byung Keol Choi, Buchun (KR); Hyun Seok Seo, Inchun (KR); Sang Wook Hong, Seoul (KR); Moon Hee Hong, Seoul (KR); Si Moon Jeon, Seoul (KR)

(73) Assignee: LG Electronics inc., Seoul (KR)

( * ) Notice: Subject to any disclaimer, the term of this patent is extended or adjusted under 35 U.S.C. 154(b) by 515 days.

(21) Appl. No.: 10/912,186

(22) Filed: Aug. 6, 2004

(65) Prior Publication Data

US 2005/0028296 A1 Feb. 10, 2005

(30) Foreign Application Priority Data

Aug. 7, 2003 (KR) ..... 10-2003-0054625
Aug. 7, 2003 (KR) ..... 10-2003-0054627

(51) Int. Cl.
*D06F 33/02* (2006.01)

(52) U.S. Cl. ..... 8/159; 68/12.06

(58) Field of Classification Search ..... 68/12.02, 68/12.06; 8/159
See application file for complete search history.

(56) References Cited

U.S. PATENT DOCUMENTS 4,779,430 A * 10/1988 Thuruta et al. ..... 68/12.04
5,507,055 A * 4/1996 Blauert et al. ..... 8/159
6,029,299 A * 2/2000 Baek et al. ..... 8/159
6,158,072 A * 12/2000 Baek et al. ..... 8/159
6,842,929 B2 * 1/2005 Kim et al. ..... 8/159

FOREIGN PATENT DOCUMENTS

| | | |
|---|---|---|
| CN | 1046571 | 10/1990 |
| DE | 199 46 245 | * 4/2000 |
| DE | 100 56 574 | * 11/2000 |
| JP | 62-243588 | * 10/1987 |
| JP | 4-20387 | * 1/1992 |
| JP | 5-7692 | * 1/1993 |
| JP | 2001-224889 | * 8/2001 |
| JP | 2001-300183 | * 10/2001 |

OTHER PUBLICATIONS

European Patent Office 0 396 058 Nov. 1990.*
English language Abstract of CN 1046571, Oct. 31, 1990.

* cited by examiner

*Primary Examiner*—Frankie L. Stinson
(74) *Attorney, Agent, or Firm*—Greenblum & Bernstein, P.L.C.

(57) ABSTRACT

A spin-dry control method in a washing machine includes sensing a first clothes amount contained in a washing tub, sensing an unbalance of the clothes and a second clothes, after execution of the sensing the first clothes amount, determining a final clothes amount, based on the first clothes amount and the second clothes amount, and executing a main spin-dry process, based on the final clothes amount.

21 Claims, 9 Drawing Sheets

SPIN-DRY CONTROL METHOD IN WASHING MACHINE

RELATED APPLICATIONS

The present disclosure relates to subject matter contained in Korean Application Nos. 2003-54625 and 2003-54627, both filed Aug. 7, 2003, the disclosures of which are herein expressly incorporated by reference in their entireties.

BACKGROUND OF THE INVENTION

1. Field of the Invention

The present invention relates to a washing machine, and more particularly to a spin-dry control method in a washing machine which is capable of enhancing the accuracy of sensing the amount of clothes contained in the washing machine, and an unbalance of the clothes, thereby achieving an optimal spin-dry operation.

2. Description of the Related Art

Generally, a washing machine is an appliance adapted to remove contaminants attached to clothes by utilizing actions of detergent and water. The recent trend of such a washing machine is to sense the amount of clothes contained in the washing machine to perform wash, rinse, spin-dry, and dry cycles in accordance with a wash water level, wash time, amount of detergent, and water flows for rinse and wash cycles determined based on the sensed clothes amount.

FIG. 1 is a sectional view illustrating an inner configuration of a general washing machine.

As shown in FIG. 1, the washing machine includes a casing 2, a water tub 10 mounted in the casing 2, and adapted to contain wash water w therein, a wash tub 20 rotatably mounted in the water tub 10, and adapted to contain clothes m, to be washed, therein, and a motor 30 adapted to support the wash tub 20 while rotating the wash tub 20.

The casing 2 is provided, at one wall thereof, with a clothes loading/unloading opening 2*a*. A door 4 is also hingably mounted to the wall of the casing 2 to open and close the clothes loading/unloading opening 2*a*.

The door 4 includes a door frame 5 hingably coupled to the casing 2, and a door glass 6 mounted to the door frame 5.

The wash tub 20 is provided with a clothes loading/unloading opening 21 for allowing the user to load clothes m into the wash tub 20 and to unload the loaded clothes m from the wash tub 20. The wash tub 20 is also provided with water holes 22, through which wash water w is introduced into and discharged from the wash tub 20.

The motor 30 includes a rotating shaft 32 extending through the water tub 10 while being supported by a bearing 34 mounted to the water tub 10. The rotating shaft 32 is connected to the wash tub 20 at an end thereof spaced away from the motor 30. A Hall sensor is also provided at the motor 30 to measure an RPM or rotated angle of the motor 30.

The washing machine also includes a water supply unit for supplying wash water w fed from the outside of the washing machine into the water tub 10. The water supply unit includes a water supply valve 42 connected to an external hose 41, and adapted to control supply of clean water through the external hose 41, and a detergent box 43 provided with a water supply passage, a detergent storing space, and an outlet to discharge water supplied into the washing machine in a state of being mixed with detergent stored therein.

The washing machine further includes a drainage unit for externally draining wash water w contained in the water tub 10. The drainage unit includes a drainage hose 45 connected to the water tub 10, and a drainage pump 46 for pumping wash water w from the water tub 10 through the drainage hose 45. The drainage hose 45 may have the form of a bellows tube. In some cases, the drainage pump 46 may be dispensed with. In this case, a drainage valve may be installed in the drainage hose 45 to control drainage of wash water w through the drainage hose 45.

The washing machine also includes a control unit 49 for controlling the motor 30, water supply valve 42, and drainage pump 46 in accordance with an operation of the user or a sensed clothes amount.

Now, operation of the conventional washing machine having the above mentioned configuration will be described.

When the washing machine is operated under the condition in which the door 4 has been closed after clothes m have been loaded in the wash tub 20, the control unit 49 senses the amount of the loaded clothes m, and then sets a desired wash water level, a desired wash time, a desired amount of detergent, and desired water flows for rinse and wash cycles, based on the sensed clothes amount.

Thereafter, the control unit 49 controls the water supply valve 42 to be opened for a time set in accordance with the sensed clothes amount, thereby supplying wash water w into the washing machine until the supplied wash water w reaches the set wash water level. The supplied wash water w is fed into the water tub 10, so that it is contained in the water tub 10. The control unit 49 then drives the motor 30 to rotate the wash tub 20 at a predetermined RPM for a predetermined time. Thus, the clothes m contained in the wash tub 20 are washed in accordance with action of the wash water w. That is, stains are removed from the clothes m. After completion of this wash cycle, the wash water existing in the water tub 10 in a contaminated state is externally drained from the washing machine through the drainage unit.

Subsequently, the washing machine performs, several times, a rinse cycle for rinsing the washed clothes m to remove bubbles remaining on the clothes m. This rinse cycle is carried out under the condition in which the water supply valve 42 and motor 30 are controlled, based on the sensed clothes amount, as in the wash cycle. The contaminated water containing the removed bubbles is externally drained from the washing machine through the drainage unit.

After performing the rinse cycle several times, the washing machine performs a spin-dry cycle for centrifugally removing moisture form the clothes m.

The spin-dry cycle includes a clothes amount sensing process for sensing the amount of clothes, to be spin-dried, to determine an optimal spin-dry or an optical spin-dry RPM, and an unbalance sensing process for sensing an unbalance of the clothes to determine whether a main spin-dry process or a clothes disentangling process is to be carried out. The spin-dry cycle also includes the main spin-dry process, which is carried out following the clothes amount sensing process or unbalance sensing process, to control the motor to rotate at high speed, thereby spin-drying the clothes.

FIG. 2 is a flow chart illustrating a conventional spin-dry control method in the above mentioned conventional washing machine. FIG. 3 is a graph depicting a variation in the RPM of the motor in the spin-dry cycle carried out in the conventional washing machine in accordance with the conventional spin-dry control method.

In accordance with the conventional spin-dry control method, as shown in FIGS. 2 and 3, when a wash or rinse cycle is completed, or when an independent spin-dry cycle is selected, a spin-dry operation is carried out in the washing machine by performing a clothes amount sensing process two times (Stages a), performing an unbalance sensing process at least one time (Stage b), and then performing a main spin-dry process (Stage d).

In the clothes amount sensing process (Stage a), the motor 30 is first started up, and is then accelerated until the RPM thereof reaches a first predetermined RPM $rpm_1$. When the RPM of the motor 30 reaches the first predetermined RPM $rpm_1$, the motor 30 is driven in a constant speed state to constantly rotate at the first predetermined RPM $rpm_1$. After the constant speed state of the motor 30 is continued for a predetermined time, the motor 30 is turned off. Meanwhile, a variation in pulse width modulation (PWM) duty value occurring in a duration from the start-up state to the constant speed state of the motor 30 is measured. Also, a rotated angle of the motor 30 caused by a surplus rotation of the motor 30 following the turning-off thereof is also measured. Based on the measured PWM duty value variation and the measured surplus rotation angle, the amount of the clothes is sensed at each of the stages a (Steps S1 and S2).

Thereafter, a mean value of the clothes amounts respectively sensed in the clothes amount sensing process carried out two times (Stages a) is derived. The derived mean clothes amount value is then determined as a final clothes amount (Step S3).

In the unbalance sensing process (Stage b), the motor 30 is accelerated until the RPM thereof reaches a second predetermined RPM $rpm_2$ higher than the first predetermined RPM $rpm_1$. When the RPM of the motor 30 reaches the second predetermined RPM $rpm_2$, the motor 30 is driven in a constant speed state to rotate constantly at the second predetermined RPM $rpm_2$. After the constant speed state of the motor 30 is continued for a predetermined time, the motor 30 is turned off. Meanwhile, an RPM ripple generated during the constant speed duration is measured. Based on the measured RPM ripple, a clothes unbalance is sensed (Step S4).

When it is determined that the clothes unbalance sensed in the unbalance sensing process (Stage b) is not less than a predetermined unbalance value, the washing machine performs a clothes disentangling process to remove the clothes unbalance (Stage c), and then again performs the unbalance sensing process (Stage b') (Steps S5 and S6).

On the other hand, when it is determined that the clothes unbalance sensed after the clothes disentangling process (Stage c) is less than the predetermined unbalance value, the motor 30 is driven at an RPM $rpm_3$ ($rpm_3 > rpm_2$) determined based on the final clothes amount, for a predetermined time determined based on the final clothes amount, thereby causing the clothes to be spin-dried at high speed (Step S7).

In accordance with the conventional spin-dry control method, however, it is impossible to obtain an optimal spin-dry result because the clothes amount sensing process for sensing a spin-dry load is carried out only at an initial stage of the spin-dry cycle (Stages a), so that there may be a difference between the actual clothes amount and the sensed clothes amount caused by removal of moisture from the clothes or other variations in spin-dry parameters occurring with the passage of time. Furthermore, the calculated clothes amount may be different from the actual clothes amount in that it may be overestimated due to a possible clothes unbalance. In addition, the sensed clothes amount may have a considerable error because the number of clothes amount sensing times (Stages a) is only two.

Meanwhile, the RPM ripple of the washing machine is influenced by the amount of clothes as well as the unbalance of clothes. In order to more accurately sense the clothes unbalance, accordingly, it is necessary to carry out the sensing of the clothes unbalance, based on the RPM ripple and clothes amount.

Where the sensing of the clothes unbalance (Stage b) is again performed, following a clothes disentangling process (Stage c) or two clothes amount sensing processes (Stages a) carried out for removal of clothes unbalance, the amount of the clothes is more or less reduced due to a spin-dry effect generated during the clothes disentangling process (Stage c) or the unbalance sensing process (Stage b). For this reason, where the sensing of the clothes unbalance is carried out, based on only the RPM ripple, as mentioned above, the measured RPM ripple may be greater than an actual RPM ripple. In this case, there may be an increased possibility that entrance to the main spin-dry process fails.

SUMMARY OF THE INVENTION

The present invention has been made in view of the above mentioned problems involved with the related art, and an object of the invention is to provide a spin-dry control method in a washing machine which is capable of sensing an amount of clothes most approximate to an actual spin-dry load, thereby achieving an optimal spin-dry operation.

Another object of the invention is to provide a spin-dry control method in a washing machine which is capable of sensing an unbalance of clothes, taking into consideration the amount of the clothes, thereby enhancing the accuracy of sensing an unbalance of the clothes.

In accordance with one aspect, the present invention provides a spin-dry control method in a washing machine, including the steps of: (A) sensing an amount of clothes contained in a washing tub; (B) sensing an unbalance of the clothes and an amount of the clothes, after execution of the step (A); (C) determining a final clothes amount, based on the clothes amount sensed at the step (A) and the clothes amount sensed at the step (B); and (D) executing a main spin-dry process, based on the final clothes amount determined at the step (C).

In accordance with another aspect, the present invention provides a spin-dry control method in a washing machine, including the steps of: (A) controlling a motor, which is adapted to rotate a washing tub containing clothes to be spin-dried, to be accelerated after a start-up thereof such that an RPM of the motor reaches a predetermined RPM; (B) controlling the motor to rotate in a constant speed state for a predetermined time when the RPM of the motor has reached the predetermined RPM; (C) turning off the motor after execution of the step (B); (D) measuring an angular velocity of the motor and a PWM duty value in a duration from a start point of the step (A) to an end point of a constant RPM stage at the step (B), and a time of the duration, and measuring an RPM ripple of the motor and a PWM duty value in an RPM rippled stage at the step (B); (E) determining a clothes amount, using the angular velocity of the motor, PWM duty values, and duration time measured at the step (D), along with an equation of motion established in association with rotation of the washing tub and clothes; and (F) determining an unbalance index, based on the clothes amount determined at the step (E) and the RPM ripple measured at the step (D).

BRIEF DESCRIPTION OF THE DRAWINGS

The above objects, and other features and advantages of the present invention will become more apparent after reading the following detailed description when taken in conjunction with the drawings, in which.

DESCRIPTION OF THE PREFERRED EMBODIMENTS

Now, preferred embodiments of a clothes amount sensing method in a washing machine according to the present invention will be described with reference to the annexed drawings.

Figure 1:
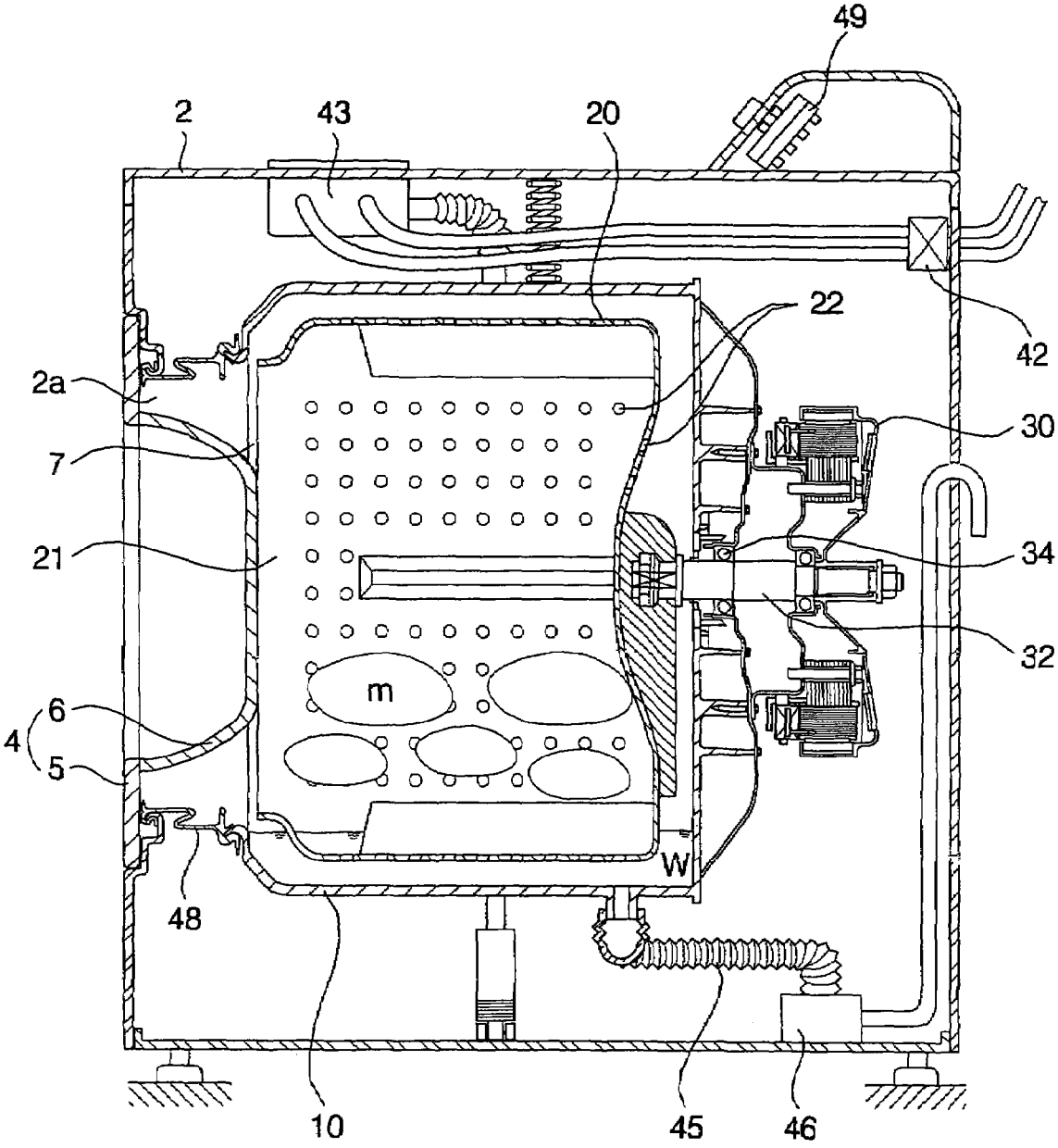
FIG. 1 (Prior Art)
FIG. 1 is a sectional view illustrating an inner configuration of a general washing machine.
Figure 2:
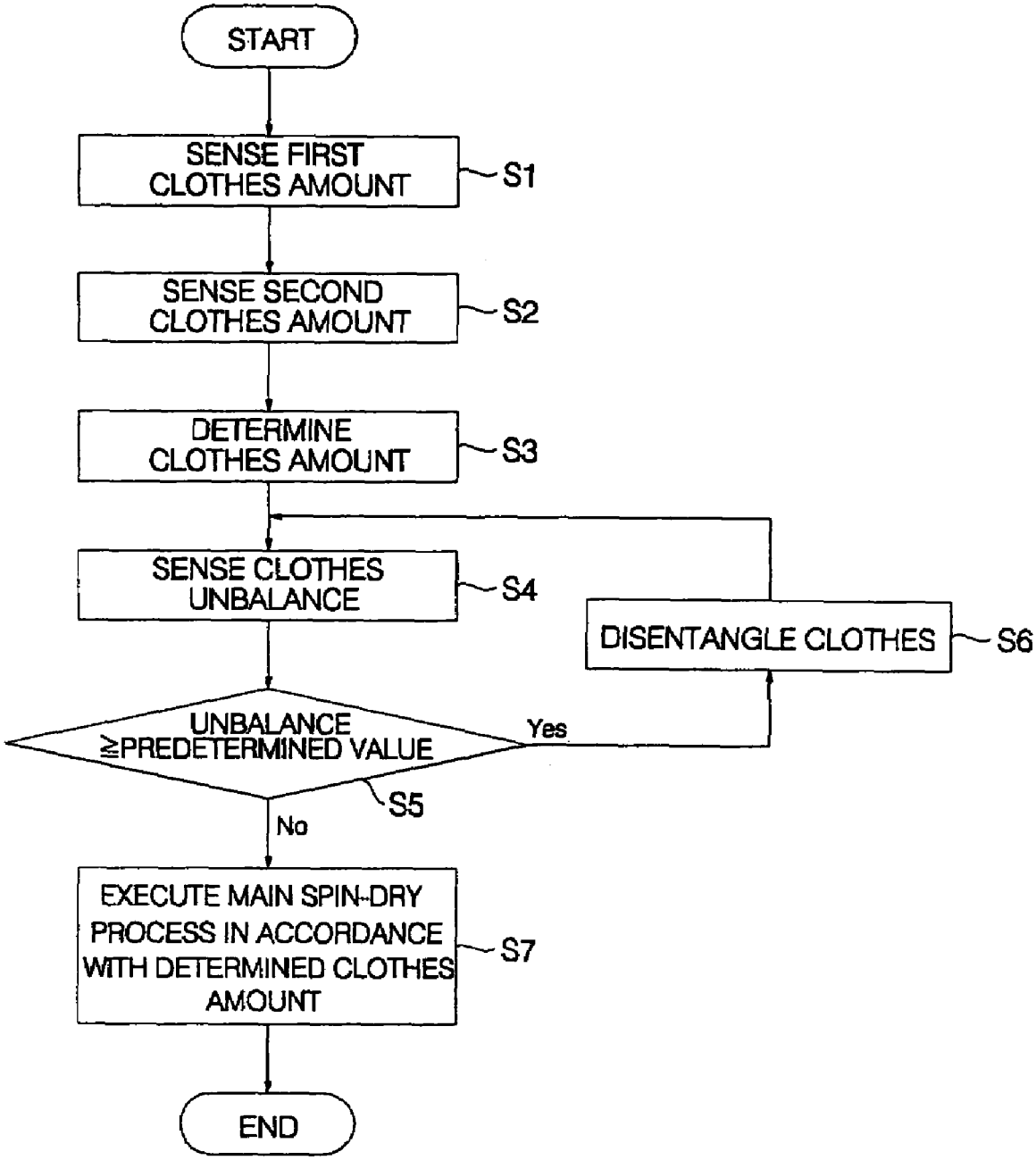
FIG. 2 (Prior Art)
FIG. 2 is a flow chart illustrating a conventional spin-dry control method in the general washing machine.
Figure 3:
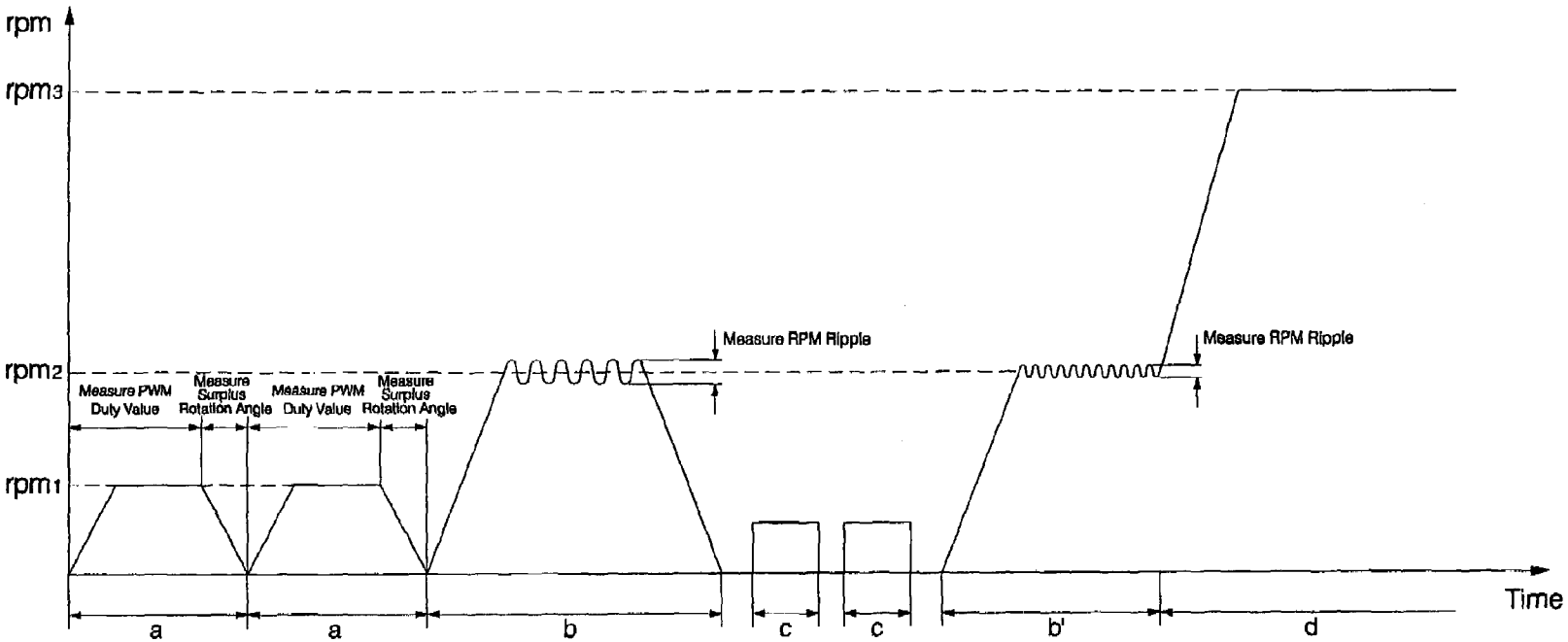
FIG. 3 (Prior Art)
FIG. 3 is a graph depicting a variation in RPM of a motor in a spin-dry cycle carried out in the general washing machine in accordance with the conventional spin-dry control method.
Figure 4:
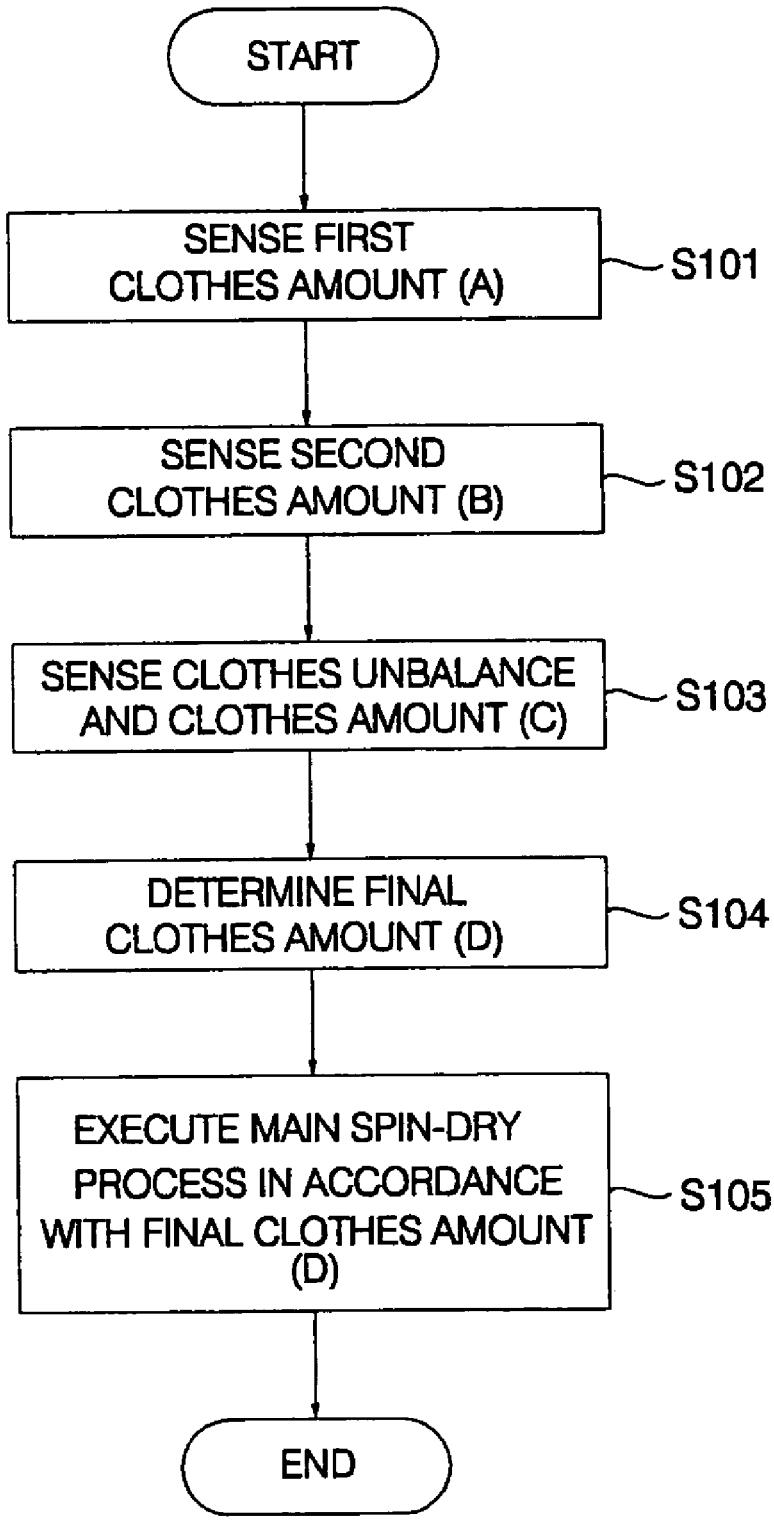
FIG. 4 is a flow chart illustrating a spin-dry control method in a washing machine in accordance with an embodiment of the present invention.
Figure 5:
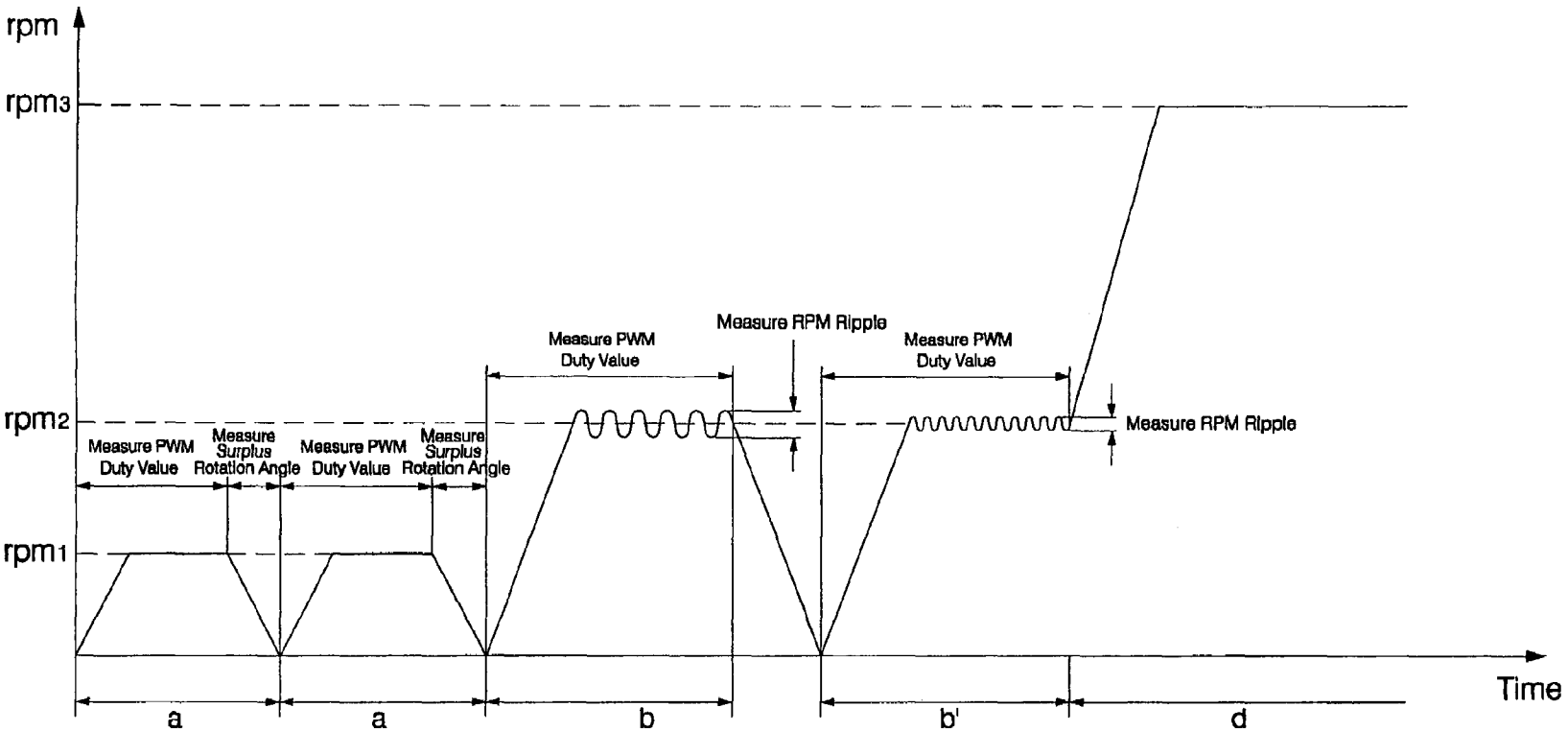
FIG. 5 is a graph depicting a variation in RPM of a motor in a spin-dry cycle carried out in the washing machine in accordance with the spin-dry control method of the present invention.

FIG. 4 is a flow chart illustrating a spin-dry control method in a washing machine in accordance with an embodiment of the present invention. FIG. 5 is a graph depicting a variation in the RPM of a motor in a spin-dry cycle carried out in the washing machine in accordance with the spin-dry control method.

In accordance with the spin-dry control method according to the illustrated embodiment of the present invention, as shown in FIGS. 4 and 5, a clothes amount sensing process (Stage a) for sensing only the amount of clothes to be spin-dried is carried out by a predetermined number of times (Steps S101 and S102).

Preferably, the number of times to carry out the clothes amount sensing process is predetermined to be two, taking into consideration a desired accuracy of sensing the clothes amount, the total time of the spin-dry cycle, etc.

In the clothes amount sensing process (Stage a), a motor adapted to rotate a wash tub receiving the clothes is first started up, and is then accelerated until the RPM thereof reaches a first predetermined RPM $rpm_1$. When the RPM of the motor reaches the first predetermined RPM $rpm_1$, the motor is driven in a constant speed state to rotate constantly at the first predetermined RPM $rpm_1$. After the constant speed state of the motor is continued for a predetermined time, the motor is turned off. Meanwhile, a variation in PWM duty value occurring in a duration until the completion of the constant speed state of the motor is measured. Also, a rotated angle of the motor caused by a surplus rotation of the motor following the turning-off thereof is also measured. Based on the measured PWM duty value variation and the measured surplus rotation angle, the amount of the clothes is sensed at each of the stages a. Thus, sensed clothes amounts A and B are obtained.

Each of the sensed clothes amounts A and B corresponds to a value obtained by adding a product of the surplus rotation angle, measured at the associated stage a, by a proportional constant to a product of the PWM duty value, measured at the associated stage a, by a proportional constant.

Thereafter, an unbalance/clothes amount sensing process (Stage b) is carried out, following the clothes amount sensing process (Stages a), to sense a clothes unbalance and a clothes amount C (Step S103).

In the unbalance/clothes amount sensing process (Stage b), the motor is accelerated until the RPM thereof reaches a second predetermined RPM $rpm_2$ ($rpm_2>rpm_1$). Thereafter, the motor is controlled so that it is driven in a constant speed state to rotate constantly at the second predetermined RPM $rpm_2$, for a predetermined time. During the constant speed state of the motor in the unbalance/clothes amount sensing process (Stage b), sensing of a clothes unbalance and clothes amount C is carried out.

When it is determined that the unbalance sensed in the unbalance/clothes amount sensing process (Stage b) is excessive, the unbalance/clothes amount sensing process (Stage b') is repeated.

On the other hand, when it is determined that the unbalance sensed in the unbalance/clothes amount sensing process (Stage b or Stages b and b') is not excessive, a final clothes determining process is carried out to determine a final clothes amount D, based on the clothes amounts A and B sensed in the clothes amount sensing process (Stages a) and the clothes amount C or clothes amounts C and C' sensed in the unbalance/clothes amount sensing process (Stage b or Stages b and b') (Step S104).

The determination of the final clothes amount D may be achieved using a mean value of the clothes amounts A and B sensed in the clothes amount sensing process (Stages a) and the clothes amount C or clothes amounts C and C' sensed in the unbalance/clothes amount sensing process (Stage b or Stages b and b') (for example, $$D = \frac{(A+B+C)}{3} \text{ or } D = \frac{(A+B+C+C')}{4}\Big\}.$$

Alternatively, the final clothes amount D may be determined, using a separate calculation method, in which different weights are applied to a part of the clothes amounts A and B sensed in the clothes amount sensing process (Stages a) and the clothes amount C or clothes amounts C and C' sensed in the unbalance/clothes amount sensing process (Stage b or Stages b and b'), respectively (for example, $D=0.2\times A+0.2\times B+0.6\times C$ or $D=0.2\times A+0.2\times B+0.3\times C+0.3\times C'$).

Thereafter, the motor is driven at a spin-dry RPM $rpm_3$ ($rpm_3>rpm_2$) determined based on the final clothes amount D, determined as above, for a time predetermined based on the final clothes amount D, thereby causing the clothes to be spin-dried at high speed. That is, a main spin-dry process (Stage d) is carried out (Step S105).

Figure 6:
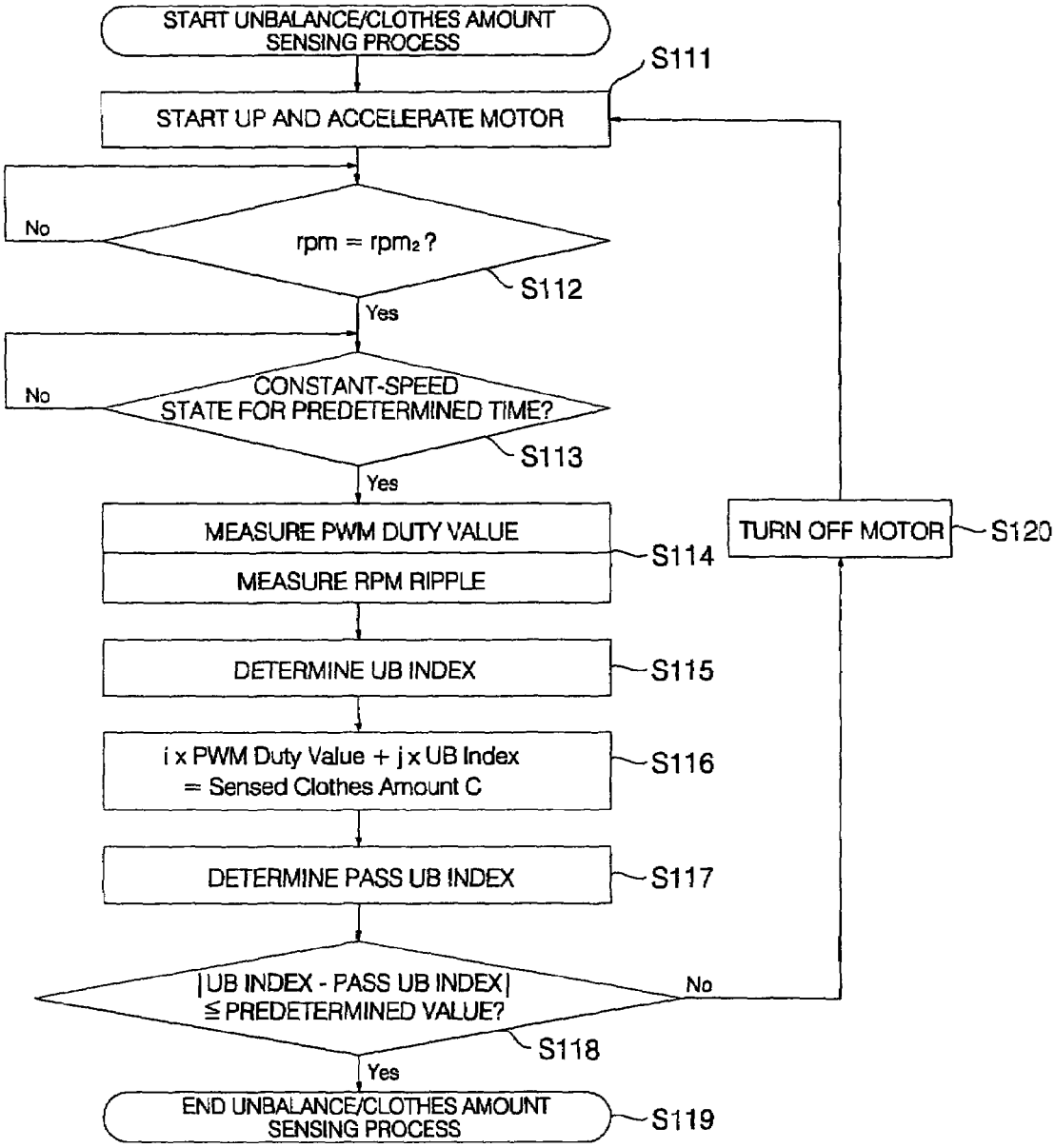
FIG. 6 is a flow chart illustrating an example of an unbalance/clothes amount sensing process in the spin-dry cycle according to the spin-dry control method of the present invention.

FIG. 6 is a flow chart illustrating an example of the unbalance/clothes amount sensing process in the spin-dry cycle according to the spin-dry control method of the present invention.

In accordance with the illustrated unbalance/clothes amount sensing process, as shown in FIGS. 5 and 6, a first procedure is carried out to control the motor to be accelerated such that the RPM of the motor reaches the second RPM $rpm_2$ (Step S111).

Thereafter, a second procedure is carried out to control the motor so that the motor is driven in a constant speed state to rotate constantly at the second predetermined RPM $rpm_2$, for a predetermined time (Steps S112 and S113).

A third procedure is then carried out to measure a PWM duty value of the motor in the acceleration and constant-speed control procedures, and to measure an RPM ripple of the motor in the constant-speed control procedure (Step S114).

In a fourth procedure, the RPM ripple measured in the third procedure is determined as an unbalance index (UB index) (Step S115).

Although the unbalance index is determined by the measured RPM ripple, as described above, it may also be determined, using equations of motion respectively established in the acceleration control procedure (Step S111) and constant-speed control procedure (Steps S112 and S113), for example, equations of Expressions 4 through 7, which appear below. It may also be possible to determine the unbalance index, using a predetermined table.

Thereafter, a fifth procedure is carried out. In the fifth procedure, the amount of the clothes is calculated by applying, to the following Expression 1, the PWM duty value measured in the third procedure (Step S114) and the unbalance index determined in the fourth procedure (Step S115). The calculated clothes amount is determined as the clothes amount C sensed in the unbalance/clothes amount sensing process (Stage b) (Step S116).

$$i \times PWM \text{ duty value} + j \times UB \text{ index} = C \qquad \text{[Expression 1]}$$

where, "i" represents a proportional constant of the PWM duty value, which can be experimentally determined, and "j" represents a proportional constant of the unbalance index, which can be experimentally determined.

That is, the clothes amount C sensed in the unbalance/clothes amount sensing process (Stage b) is a clothes amount sensed taking into consideration the unbalance of the clothes.

A sixth procedure is then carried out to determine, based on the clothes amount C calculated in the fifth procedure, a pass unbalance index for determining whether or not a main spin-dry process is to be carried out (Step S117).

The determination of the pass unbalance index may be achieved using a predetermined table, as in the determination of the unbalance index.

In a seventh procedure, the pass unbalance index determined in the sixth procedure is compared with the unbalance index determined in the fourth procedure (Step S118).

When it is determined, based on the comparison result in the seventh procedure, that the unbalance index is not more than the pass unbalance index, or an absolute value of a difference between the unbalance index and the pass unbalance index is not more than a predetermined value, an eighth procedure is carried out to complete the unbalance/clothes amount sensing process (Step S119).

On the other hand, when it is determined, based on the comparison result in the seventh procedure, that the unbalance index is more than the pass unbalance index, or the absolute value of the difference between the unbalance index and the pass unbalance index is more than the predetermined value, a ninth procedure is carried out to turn off the motor for a predetermined time (Step S120).

When the RPM of the motor reaches zero after the turning-off of the motor in the ninth procedure, the unbalance/clothes amount sensing process (Step S103) is repeated (Stage b').

Figure 7:
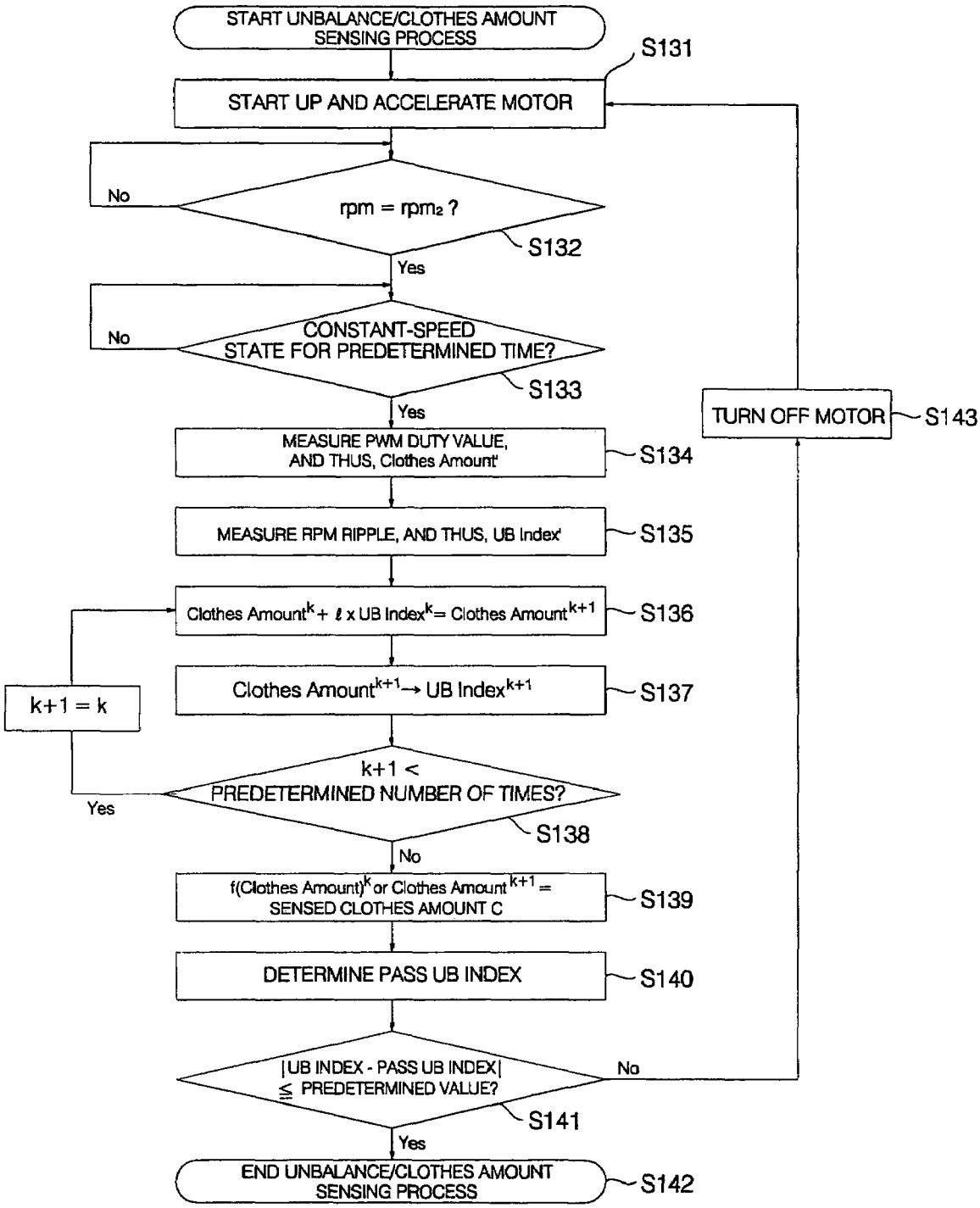
FIG. 7 is a flow chart illustrating another example of the unbalance/clothes amount sensing process in the spin-dry cycle according to the spin-dry control method of the present invention.

FIG. 7 is a flow chart illustrating another example of the unbalance/clothes amount sensing process in the spin-dry cycle according to the spin-dry control method of the present invention.

In accordance with this unbalance/clothes amount sensing process, as shown in FIGS. 5 and 7, a first procedure is carried out to control the motor to be accelerated such that the RPM of the motor reaches the second RPM $rpm_2$ (Step S131).

Thereafter, a second procedure is carried out to control the motor so that the motor is driven in a constant speed state to rotate constantly at the second predetermined RPM $rpm_2$, for a predetermined time (Steps S132 and S133).

A third procedure is then carried out to measure a PWM duty value of the motor in the first and second procedures, thereby determining a clothes amount (Clothes $Amount^1$) (Step S134).

Since the clothes amount Clothes $Amount^1$ is proportional to the PWM duty value, it may be determined by a value obtained after multiplying a proportional constant to the PWM duty value. The clothes amount Clothes $Amount^1$ may also be determined, using equations of motion respectively established in the acceleration control procedure (Step S131) and constant-speed control procedure (Steps S132 and S133), for example, equations of Expressions 4 through 6, which appear below. It may also be possible to determine the unbalance index, using a predetermined table.

Subsequently, a fourth procedure is carried out to measure an RPM ripple of the motor in the second procedure, thereby determining an unbalance index UB $Index^1$ (Step S135).

Although the unbalance index UB $Index^1$ is determined by the measured RPM ripple, as described above, it may also be determined, using equations of motion respectively established in the acceleration control procedure (Step S131) and constant-speed control procedure (Steps S132 and S133), as in the determination of the clothes amount Clothes $Amount^1$, for example, equations of Expressions 4 through 7, which appear below. It may also be possible to determine the unbalance index UB $Index^1$, using a predetermined table.

Thereafter, a fifth procedure is carried out to execute, a predetermined number of times (for example, 3 times), an iterative calculation based on the clothes amount Clothes $Amount^1$ determined in the third procedure and the unbalance index UB $Index^1$ determined in the fourth procedure, thereby iteratively calculating new clothes amounts Clothes $Amount^{k+1}$ and unbalance indexes UB $Index^{k+1}$ (Steps S136, S137, and S138). In the fifth procedure, a new clothes amount Clothes $Amount^2$ is first determined, based on the clothes amount Clothes $Amount^1$ determined in the third procedure and the unbalance index UB $Index^1$ determined in the fourth procedure (Step S136). Based on the new clothes amount Clothes $Amount^2$, a new unbalance index UB $Index^2$ is then determined (Step S137).

The determination of the new clothes amount Clothes $Amount^2$ is achieved by applying, to the following Expression 2, the clothes amount Clothes $Amount^1$ determined in the third procedure and the unbalance index UB Index[1] determined in the fourth procedure.

$$\text{Clothes Amount}^{k}+l\times UB\ \text{Index}^{k}=\text{Clothes Amount}^{k+1} \quad \text{[Expression 2]}$$

where, "l" is a proportional constant of an unbalance index, which is experimentally determined.

The new clothes amount Clothes Amount[2] determined using Expression 2 is used in the determination of the new unbalance index UB Index[2] made using equations of motion respectively established in the acceleration control procedure (Step S131) and constant-speed control procedure (Steps S132 and S133), or using a predetermined table, for example, equations of Expressions 4 through 7, which appear below.

Preferably, the predetermined number of times to execute the iterative calculation is not less than the number of times, by which the clothes sensing process has been carried out in the initial stage of the spin-dry cycle to sense the clothes amounts A and B.

Thus, a plurality of clothes amount data, the number of which is more than the number of times, by which the clothes sensing process has been carried out (Steps S101 and S102), for example, three clothes amounts Clothes Amount[1], Clothes Amount[2], and Clothes Amount[3], are obtained. Accordingly, it is possible to minimize an error in the clothes amount C sensed in the unbalance/clothes amount sensing process, that is, step S103.

Thereafter, a sixth procedure is carried out to determine the clothes amount C sensed in the unbalance/clothes amount sensing process (Step S103), based on the clothes amount Clothes Amount[1] determined in the third procedure and the clothes amounts Clothes Amount[2] and Clothes Amount[3] iteratively calculated in the fifth procedure (Step S139). In the sixth procedure, a value, obtained after applying the clothes amounts Clothes Amount[1], Clothes Amount[2], and Clothes Amount[3] to a particular calculation method, may be determined as the clothes amount C sensed in the unbalance/clothes amount sensing process. For example, an average value of the clothes amounts Clothes Amount[1], Clothes Amount[2], and Clothes Amount[3] may be determined as the clothes amount C sensed in the unbalance/clothes amount sensing process. The average value of the clothes amounts Clothes Amount[1], Clothes Amount[2], and Clothes Amount[3] may be calculated as follows:

$$ClothesAmount^{average} = \frac{ClothesAmount^{1} + ClothesAmount^{2} + ClothesAmount^{3}}{3} \quad \text{[Expression 3]}$$

Subsequently, a seventh procedure is carried out to determine, based on the sensed clothes amount C determined in the sixth procedure, a pass unbalance index for determining whether or not a main spin-dry process is to be carried out (Step S140).

The determination of the pass unbalance index may be achieved using a table predetermined based on the sensed clothes amount C, equations of motion respectively established in the acceleration control procedure (Step S131) and constant-speed control procedure (Steps S132 and S133), for example, equations of Expressions 4 through 7, which appear below.

In an eighth procedure, the pass unbalance index determined in the seventh procedure is compared with an unbalance index obtained in accordance with the iterative calculation in the fifth procedure (Step S141).

When it is determined, based on the comparison result in the eighth procedure, that an absolute value of a difference between the unbalance index and the pass unbalance index is not more than a predetermined value, a ninth procedure is carried out to complete the unbalance/clothes amount sensing process, that is, step S103 (Step S142).

On the other hand, when it is determined, based on the comparison result in the eighth procedure, that the absolute value of the difference between the unbalance index and the pass unbalance index is more than the predetermined value, a tenth procedure is carried out to turn off the motor for a predetermined time (Step S143).

When the RPM of the motor reaches zero after the turning-off of the motor in the tenth procedure, the unbalance/clothes amount sensing process (Step S103) is again carried out.

Figure 8:
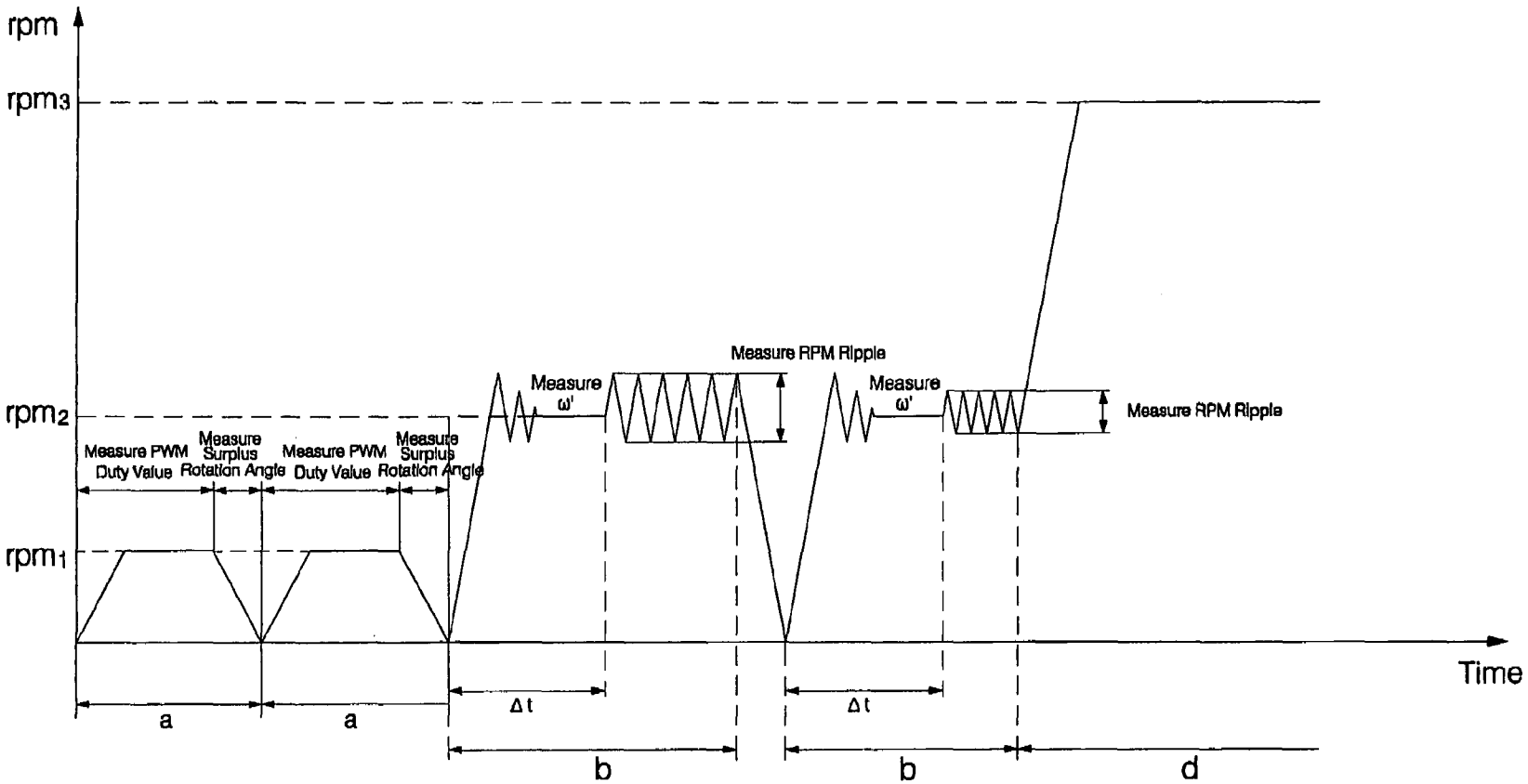
FIG. 8 is a graph depicting a variation in RPM of the motor in a spin-dry cycle carried out in the washing machine in accordance with a spin-dry control method according to another embodiment of the present invention.
Figure 9:
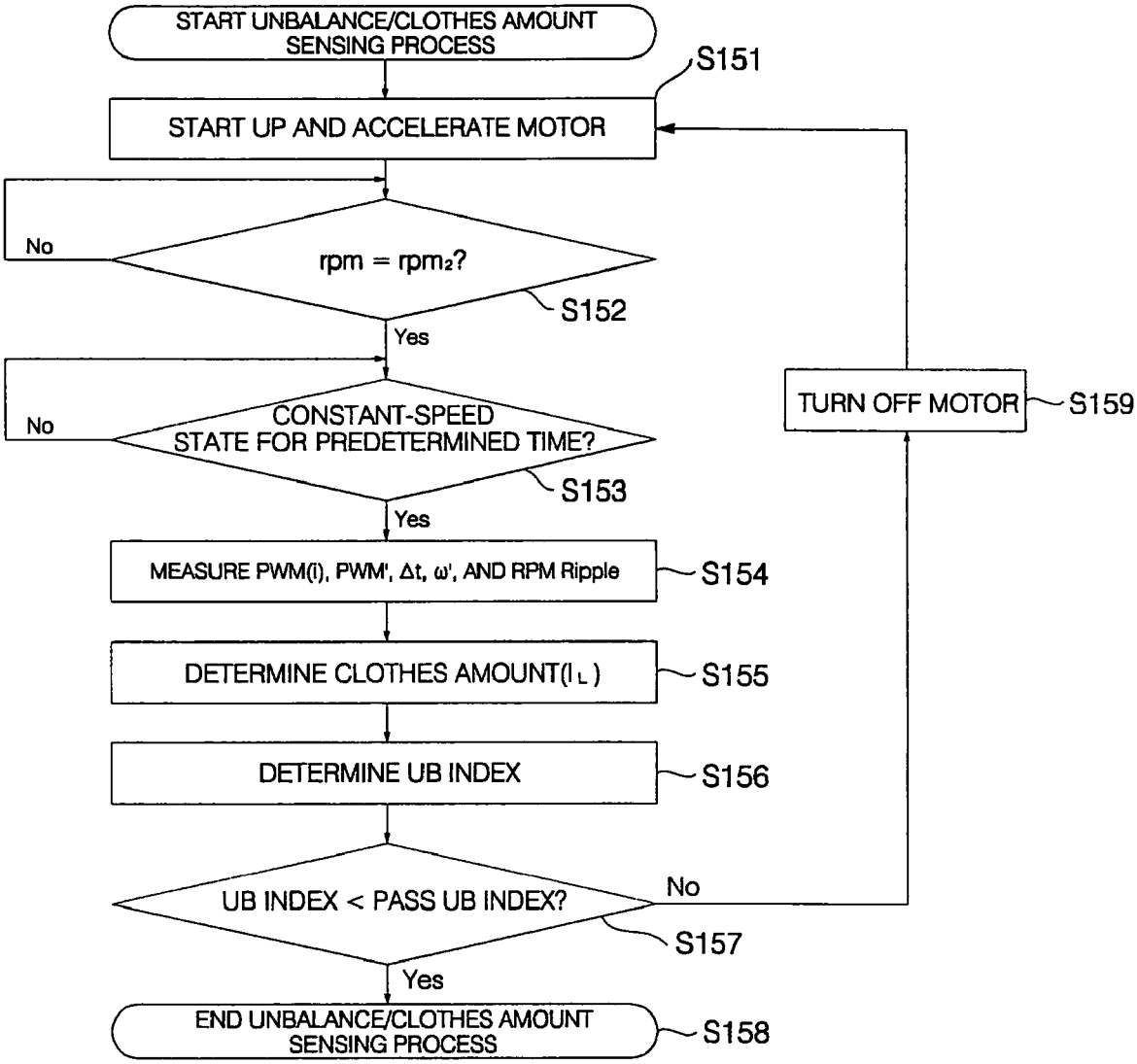
FIG. 9 is a flow chart illustrating an unbalance/clothes amount sensing process in the spin-dry cycle according to the embodiment of the present invention shown in FIG. 8.

FIG. 8 is a graph depicting a variation in the RPM of the motor in a spin-dry cycle carried out in the washing machine in accordance with a spin-dry control method according to another embodiment of the present invention. FIG. 9 is a flow chart illustrating an unbalance/clothes amount sensing process in the spin-dry cycle according to the embodiment of the present invention shown in FIG. 8.

In accordance with the illustrated unbalance/clothes amount sensing process, as shown in FIGS. 8 and 9, a first procedure is carried out to control the motor to be accelerated such that the RPM of the motor reaches the second RPM $rpm_2$ (Step S151).

After the RPM of the motor reaches the second RPM $rpm_2$, a second procedure is carried out. That is, a constant PWM duty value is inputted to the motor when the RPM of the motor reaches the second RPM $rpm_2$, thereby controlling the motor to be driven in a constant speed state, that is, to rotate constantly at the second predetermined RPM $rpm_2$, for a predetermined time (Step S152).

After the constant speed state of the motor is continued for the predetermined time, a third procedure is carried out to turn off the motor. As a result, the motor is decelerated while carrying out a surplus rotation thereof (Step S153).

In a fourth procedure, an angular velocity of the motor and a PWM duty value in a duration from a start point of the acceleration control procedure to an end point of a constant RPM stage in the constant-speed control procedure, and the time of the duration are measured (Step S154). In the fourth procedure, an RPM ripple of the motor and a PWM duty value in an RPM rippled stage in the constant-speed control procedure are also measured.

Thereafter, a fifth procedure is carried out. In the fifth procedure, a clothes amount is determined, using the angular velocity of the motor, PWM duty values, and duration time measured in the fourth procedure, along with an equation of motion established in association with rotation of the washing tub and clothes (Step S155).

The equation of motion established in association with rotation of the washing tub and clothes is expressed as follows:

$$(I_{drum} + I_L)\frac{d\omega(t)}{dt} = T_{drive}(t) - T_{friction} \quad \text{[Expression 4]}$$

where, "$I_{drum}$" represents an inertial moment of the washing tub or drum, which may be experimentally determined, "$I_L$" represents an inertial moment of the clothes, "$T_{drive}$" represents a drive torque of the motor, and "$T_{friction}$" represents a friction torque of the motor.

The equation of motion expressed by Expression 4 may be integrated as follows:

$$(I_{drum} + I_L)w' = \int_0^{\Delta t} T_{drive}(t)dt - T_{friction}\Delta t = \sum_{i=1}^{n} k_1 PWM(i)\frac{\Delta t}{n} - k_1 PWM'\Delta t \quad \text{[Expression 5]}$$

Expression 5 may be arranged with respect to "$I_L$" as follows:

$$I_L = \frac{k_1\left(\sum_{i=1}^{n}\frac{PWM(i)}{n} - PWM'\right)\Delta t}{\omega'} - I_{drum} \quad \text{[Expression 6]}$$

where, "$I_L$" represents an inertial moment of the clothes, "PWM(i)" represents a PWM duty value in the duration from the start point of the acceleration control procedure to the end point of the constant RPM stage in the constant-speed control procedure, "PWM'" represents a PWM duty value in the RPM rippled stage in the constant-speed control procedure, "Δt" represents the time of the duration from the start point of the acceleration control procedure to the end point of the constant RPM stage in the constant-speed control procedure, "ω'" represents an angular velocity of the motor in the duration from the start point of the acceleration control procedure to the end point of the constant RPM stage in the constant-speed control procedure, "$I_{drum}$" represents an inertial moment of the washing tub or drum, which may be experimentally determined, and "$k_1$" represents a proportional constant, which may be experimentally determined.

In a sixth procedure, an unbalance of the clothes is determined, based on the clothes amount determined in the fifth procedure, and the RPM ripple measured in the fourth procedure (Step S156).

The determination of the unbalance is achieved using the following Expression:

$$UB\ \text{Index} = k_2 \times I_L \times \text{RPM ripple} \quad \text{[Expression 7]}$$

where, "UB Index" represents an unbalance index, "RPM ripple" represents an RPM ripple of the motor in the RPM rippled stage in the constant-speed control procedure, and "$k_2$" represents a proportional constant, which may be experimentally determined.

In a seventh procedure, the determined unbalance index UB index is compared with a predetermined pass unbalance index (Step S157).

When it is determined, based on the comparison result in the seventh procedure, that the unbalance index is less than the predetermined pass unbalance index, an eighth procedure is carried out to complete the unbalance/clothes amount sensing process (Step S158).

On the other hand, when it is determined, based on the comparison result in the seventh procedure, that the unbalance index is not less than the predetermined pass unbalance index, a ninth procedure is carried out to turn off the motor (Step S159).

When the RPM of the motor reaches zero after the turning-off of the motor in the ninth procedure, the unbalance/clothes amount sensing process (Step S103) is again carried out.

Although the spin-dry control method according to the present invention has been described in conjunction with various embodiments thereof, it is not limited thereto.

As apparent from the above description, in accordance with the spin-dry control method of the present invention, an unbalance/clothes amount sensing process is carried out, following a clothes amount sensing process, to sense a clothes unbalance and clothes amount. Based on the sensed clothes unbalance and clothes amount, a final clothes amount to be applied to a main spin-dry process is determined. Since the main spin-dry process is carried out, based on the final clothes amount, it is possible to minimize an error in the sensed clothes amount caused by variations in spin-dry parameters occurring with the passage of time. Since an increased number of clothes sensing times is used, there is an advantage of an enhancement in clothes sensing accuracy.

In the unbalance/clothes amount sensing process, the clothes amount sensing is carried out, taking into consideration an unbalance index. Accordingly, it is possible to sense a clothes amount most approximate to an actual clothes amount. Thus, an optimal spin-dry operation can be achieved.

In accordance with the spin-dry control method of the present invention, the unbalance sensing is carried out, taking into consideration the sensed clothes amount. Accordingly, it is possible to sense a clothes unbalance varied depending on a variation in clothes amount. Thus, there is an advantage of an enhancement in unbalance sensing accuracy.

In accordance with the spin-dry control method of the present invention, there is also an advantage in that it is possible to sense both the clothes unbalance and the clothes amount through a single process involving procedures of accelerating the motor, maintaining the motor at a constant speed, and decelerating the motor.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. A spin-dry control method in a washing machine, comprising:

sensing a first clothes amount contained in a washing tub;

sensing an unbalance of the clothes and a second clothes amount, after execution of the sensing of the first clothes amount;

determining a final clothes amount, based on the first clothes amount and the second clothes amount; and executing a main spin-dry process, based on the final clothes amount, wherein the sensing the unbalance of the clothes and the second clothes amount comprises:

accelerating a motor, which is adapted to rotate the washing tub, after a start-up thereof such that an RPM of the motor reaches a predetermined RPM;

constantly rotating the motor in a constant speed state for a predetermined time when the RPM of the motor has reached the predetermined RPM;

measuring a pulse width modulation (PWM) duty value of the motor at the accelerating and the constantly rotating;

measuring an RPM ripple of the motor at the constantly rotating;

determining an unbalance index based on the RPM ripple; and determining the second clothes amount based on the PWM duty value and the unbalance index.

2. The spin-dry control method according to claim 1, wherein the sensing the unbalance of the clothes and the second clothes amount further comprises:

determining a pass unbalance index adapted to determine whether or not the main spin-dry process is to be executed, based on the second clothes amount;

comparing the unbalance index with the pass unbalance index; and if it is determined that the unbalance index is not more than the pass unbalance index, or an absolute value of a difference between the unbalance index and the pass unbalance index is not more than a predetermined value, completing the sensing the unbalance of the clothes and the second clothes amount.

3. The spin-dry control method according to claim 2, wherein the sensing the unbalance of the clothes and the second clothes amount further comprises:

if it is determined that the unbalance index is more than the pass unbalance index, or the absolute value of the difference between the unbalance index and the pass unbalance index is more than the predetermined value, turning off the motor, and repeating thesensing the unbalance of the clothes and the second clothes amount.

4. The spin-dry control method according to claim 1, wherein the final clothes amount is an average value of the first clothes amount and the second clothes amount.

5. A spin-dry control method in a washing machine, comprising:

sensing a first clothes amount contained in a washing tub;

sensing an unbalance of the clothes and a second clothes amount, after execution of the sensing of the first clothes amount;

determining a final clothes amount, based on the first clothes amount and the second clothes amount; and executing a main spin-dry process, based on the final clothes amount, wherein the sensing the unbalance of the clothes and the second clothes amount comprises:

accelerating a motor, which is adapted to rotate the washing tub, after a start-up thereof such that an RPM of the motor reaches a predetermined RPM;

constantly rotating the motor in a constant speed state for a predetermined time when the RPM of the motor has reached the predetermined RPM;

measuring a pulse width modulation (PWM) duty value of the motor at the accelerating and the constantly rotating, and determining a PWM clothes amount, based on the measured PWM duty value;

measuring an RPM ripple of the motor and determining an unbalance index, based on the measured RPM ripple;

executing, a predetermined number of times, an iterative calculation based on the PWM clothes amount determined and the unbalance index, thereby iteratively calculating a plurality of PWM-ripple clothes amounts and a plurality of PWM unbalance indexes; and determining the second clothes amount, based on the PWM clothes amount and the iteratively calculated PWM-ripple clothes amounts.

6. The spin-dry control method according to claim 5, wherein the predetermined number of times to execute the iterative calculation is not less than a number of clothes amount sensing times at thesensing a first clothes amount.

7. The spin-dry control method according to claim 5, wherein the sensing the unbalance of the clothes and the second clothes amount further comprises:

determining a pass unbalance index adapted to determine whether or not the main spin-dry process is to be executed, based on the second clothes amount;

comparing a final one of the PWM unbalance indexes with the pass unbalance index; and if it is determined that an absolute value of a difference between the final PWM unbalance index and the pass unbalance index is not more than a predetermined value, completing thesensing the unbalance of the clothes and the second clothes amount.

8. The spin-dry control method according to claim 7, wherein the sensing the unbalance of the clothes and the second clothes amount further comprises:

if it is determined that the absolute value of the difference between the final PWM unbalance index and the pass unbalance index is more than the predetermined value, turning off the motor, and repeating thesensing the unbalance of the clothes and the second clothes amount.

9. A spin-dry control method in a washing machine, comprising:

sensing a first clothes amount contained in a washing tub;

sensing an unbalance of the clothes and a second clothes amount, after execution of the sensing of the first clothes amount;

determining a final clothes amount, based on the first clothes amount and the second clothes amount; and executing a main spin-dry process, based on the final clothes amount, wherein the sensing the unbalance of the clothes and the second clothes amount comprises:

accelerating a motor, which is adapted to rotate the washing tub, after a start-up thereof such that an RPM of the motor reaches a predetermined RPM;

constantly rotating the motor to rotate in a constant speed state for a predetermined time when the RPM of the motor has reached the predetermined RPM;

turning off the motor after execution of the constantly rotating;

measuring an angular velocity of the motor and a PWM duty value in a duration from a start point of the accelerating to an end point of a constant RPM stage at the constantly rotating, and a time of the duration, and measuring an RPM ripple of the motor and a PWM duty value in an RPM rippled stage at the constantly rotating; and measuring an angular clothes amount, using the angular velocity of the motor, the PWM duty values, and the duration time along with an equation of motion established in association with rotation of the washing tub and clothes, and determining the measured angular clothes amount as the second clothes amount.

10. The spin-dry control method according to claim 9, wherein the determination of the second clothes amount is carried out, using the following Expression 1:

$$I_L = \frac{k_1\left(\sum_{i=1}^{n}\frac{PWM(i)}{n} - PWM'\right)\Delta t}{\omega'} - I_{drum} \quad \text{[Expression 1]}$$

where, "$I_L$" represents an inertial moment of the clothes, "PWM(i)" represents the PWM duty value in the duration from the start point of the sensing the first clothes to the end point of the constant RPM stage in thesensing the unbalance of the clothes and the second clothes amount, "PWM'" represents a PWM duty value in the RPM rippled stage atsensing the unbalance of the clothes and the second clothes amount, "Δt" represents the time of the duration from the start point of the sensing the first clothes to the end point of the constant RPM stage at thesensing the unbalance of the clothes and the second clothes amount, "ω'" represents the angular velocity of the motor in the duration from the start point of the sensing the first clothes to the end point of the constant RPM stage at thesensing the unbalance of the clothes and the second clothes amount, "$I_{drum}$" represents an inertial moment of the washing tub, and "$k_1$" represents a proportional constant.

11. The spin-dry control method according to claim 9, wherein the sensing the unbalance of the clothes and the second clothes amount further comprises:

etermining an unbalance index, based on the second clothes amount and the RPM ripple.

12. The spin-dry control method according to claim 11, wherein the determination of the unbalance index is carried out, using the following Expression 2:

$$UB\ \text{Index} = K_2 \times I_L \times RPM\ \text{ripple} \quad \text{[Expression 2]}$$

where, "UB Index" represents the unbalance index, "RPM ripple" represents the RPM ripple of the motor in the RPM rippled stage at thesensing the unbalance of the clothes and the second clothes amount, and "$k_2$" represents a proportional constant.

13. The spin-dry control method according to claim 11, wherein the sensing the unbalance of the clothes and the second clothes amount further comprises:

comparing the unbalance index with a predetermined pass unbalance index; and if it is determined that the unbalance index is not more than the predetermined pass unbalance index, or an absolute value of a difference between the unbalance index and the predetermined pass unbalance index is not more than a predetermined value, completing the sensing the unbalance of the clothes and the second clothes amount.

14. The spin-dry control method according to claim 13, wherein the sensing the unbalance of the clothes and the second clothes amount further comprises:

if it is determined that the unbalance index is more than the pass unbalance index, or the absolute value of the difference between the unbalance index and the pass unbalance index is more than the predetermined value, turning off the motor, and repeating thesensing the unbalance of the clothes and the second clothes amount.

15. A spin-dry control method in a washing machine, comprising:

accelerating a motor, which is adapted to rotate a washing tub containing clothes to be spin-dried, after a start-up thereof such that an RPM of the motor reaches a predetermined RPM;

constantly rotating the motor to rotate in a constant speed state for a predetermined time when the RPM of the motor has reached the predetermined RPM;

turning off the motor after execution of the constantly rotating;

measuring an angular velocity of the motor and a PWM duty value in a duration from a start point of the accelerating to an end point of a constant RPM stage at the constantly rotating, and a time of the duration, and measuring an RPM ripple of the motor and a PWM duty value in an RPM rippled stage at the constantly rotating;

determining a clothes amount, using the angular velocity of the motor, the PWM duty values, and the duration time, along with an equation of motion established in association with rotation of the washing tub and clothes; and determining an unbalance index, based on the clothes amount and the RPM ripple.

16. The spin-dry control method according to claim 15, wherein the determination of the clothes amount is carried out, using the following Expression 1:

$$I_L = \frac{k_1\left(\sum_{i=1}^{n}\frac{PWM(i)}{n} - PWM'\right)\Delta t}{\omega'} - I_{drum} \quad \text{[Expression 1]}$$

where, $I_L$ represents an inertial moment of the clothes, "PWM(i)" represents the PWM duty value in the duration from the start point of the accelerating to the end point of the constant RPM stage in the constantly rotating, "PWM'" represents a PWM duty value in the RPM rippled stage at the constantly rotating, "Δt" represents the time of the duration from the start point of the accelerating to the end point of the constant RPM stage at the constantly rotating, "ω'" represents the angular velocity of the motor in the duration from the start point of the accelerating to the end point of the constant RPM stage at the constantly rotating, "$I_{drum}$" represents an inertial moment of the washing tub, and "$k_1$" represents a proportional constant.

17. The spin-dry control method according to claim 15, wherein the determination of the unbalance index is carried out, using the following Expression 2:

$$UB\ \text{Index} = K_2 \times I_L \times \text{RPM ripple} \quad \text{[Expression2]}$$

where, "UB Index" represents the unbalance index, "RPM ripple" represents the RPM ripple of the motor in the RPM rippled stage at the constantly rotating, and "$k_2$" represents a proportional constant.

18. The spin-dry control method according to claim 15, further comprising:

comparing the unbalance index with a predetermined unbalance index; and if it is determined that the unbalance index is not more than the predetermined pass unbalance index, or an absolute value of a difference between the unbalance index and the predetermined pass unbalance index is not more than a predetermined value, determining a final clothes amount, based on the clothes amount, and executing a main spin-dry process, based on the determined final clothes amount.

19. The spin-dry control method according to claim 18, further comprising:

if it is determined that the unbalance index is more than the pass unbalance index, or the absolute value of the difference between the unbalance index and the pass unbalance index is more than the predetermined value, turning off the motor, and repeating the accelerating to the turning off.

20. A spin-dry control method in a washing machine, comprising:

sensing a first clothes amount contained in a washing tub;

sensing an unbalance of the clothes and a second clothes amount, after execution of the sensing of the first clothes amount;

determining a final clothes amount, based on the first clothes amount and the second clothes amount; and executing a main spin-dry process, based on the final clothes amount, wherein the sensing the unbalance of the clothes and the second clothes amount comprises:

Accelerating a motor, which is adapted to rotate the washing tub, after a start-up thereof such that an RPM of the motor reaches a predetermined RPM;

constantly rotating the motor in a constant speed state for a predetermined time when the RPM of the motor has reached the predetermined RPM;

measuring a pulse width modulation (PWM) duty value of the motor at the accelerating and the constantly rotating;

measuring an RPM ripple of the motor at the constantly rotating;

determining an unbalance index using a plurality of equations based on the accelerating an the constantly rotating; and determining the second clothes amount based on the PWM duty value and the unbalance index.

21. A spin-dry control method in a washing machine, comprising:

sensing a first clothes amount contained in a washing tub;

sensing an unbalance of the clothes and a second clothes amount, after execution of the sensing of the first clothes amount;

determining a final clothes amount, based on the first clothes amount and the second clothes amount; and executing a main spin-dry process, based on the final clothes amount, wherein the sensing the unbalance of the clothes and the second clothes amount comprises:

accelerating a motor, which is adapted to rotate the washing tub, after a start-up thereof such that an RPM of the motor reaches a predetermined RPM;

constantly rotating the motor in a constant speed state for a predetermined time when the RPM of the motor has reached the predetermined RPM;

measuring a pulse width modulation (PWM) duty value of the motor at the accelerating and the constantly rotating;

measuring an RPM ripple of the motor at the constantly rotating;

determining an unbalance index using a predetermined table; and determining the second clothes amount based on the PWM duty value and the unbalance index.

* * * * *